US007385164B2

(12) United States Patent
Sun

(10) Patent No.: US 7,385,164 B2
(45) Date of Patent: Jun. 10, 2008

(54) REVOLVING BASE OF MICROWAVE OVEN

(75) Inventor: Aiguo Sun, Fujian (CN)

(73) Assignee: Tsann Kuen (China) Enterprise Co., Ltd., Xiamen, Fujian (CN)

( * ) Notice: Subject to any disclaimer, the term of this patent is extended or adjusted under 35 U.S.C. 154(b) by 0 days.

(21) Appl. No.: 11/825,724

(22) Filed: Jul. 9, 2007

(65) Prior Publication Data

US 2008/0017636 A1 Jan. 24, 2008

(30) Foreign Application Priority Data

Jul. 18, 2006 (CN) ..... 2006 2 0087120

(51) Int. Cl.
*H05B 6/80* (2006.01)

(52) U.S. Cl. ..... 219/756; 219/752; 219/762

(58) Field of Classification Search ..... 219/756, 219/762, 752–754, 678–679
See application file for complete search history.

(56) References Cited

U.S. PATENT DOCUMENTS 4,219,716 A * 8/1980 Kaufman et al. ..... 219/756
4,694,132 A * 9/1987 Liu ..... 219/755
5,422,464 A * 6/1995 Jeon ..... 219/708

* cited by examiner

*Primary Examiner*—Philip H. Leung
(74) *Attorney, Agent, or Firm*—Greer, Burns & Crain, Ltd.

(57) ABSTRACT

A revolving base of microwave oven, including an upper chassis, a nether chassis movably located under the upper chassis, an upper distribution box locating on the bottom of the upper chassis, a nether distribution box locating on a top side of the nether chassis, idler wheel groups cooperating between the upper chassis and the nether chassis; the upper chassis, the upper distribution box, the nether distribution box and the nether chassis axially locate through a screw; a smaller conducting ring and a bigger conducting ring are embedded in the bottom of the upper distribution box, the smaller conducting ring and the bigger conducting ring center on the screw, the smaller conducting ring and the bigger conducting ring respectively have electrical union joints drilling through upwards the upper distribution box; a smaller conducting strip and a bigger conducting strip are embedded in the top side of the nether distribution box.

4 Claims, 4 Drawing Sheets

REVOLVING BASE OF MICROWAVE OVEN

TECHNICAL FIELD

The utility model relates to accessory structure of microwave oven, concretely to a revolving base of microwave oven.

BACKGROUND OF TECHNOLOGY

Traditional microwave oven is cuboid, the oven door of the microwave oven is situated at one side of the microwave oven. When microwave oven is placed in a cabinet, the oven door is opposite to the door of cabinet; when microwave oven is placed on hearth, the oven door is opposite to the position being convenient to users. It is obvious that the position of the oven door is usually changeless.

However, the designs of household electric appliances are much more humanized along with the improving of the quality of life of people. For example, microwave oven can be designed as cylinder, the oven door can take up half area of cylinder, accordingly, the area of oven door greatly increased. Foods can be much more expediently taken out because of the half cylinder of oven door.

At the same time, on some occasions, especially in the case of bigger room, user want to take out food from microwave oven, when he is not opposite to the oven door, the user must move around to the oven door or put up microwave oven to get food, which is discommodious to use.

THE CONTENT OF THE UTILITY MODEL

The present utility model provides a revolving base of microwave oven, to overcome the disadvantages of the inconvenience of taking food out from microwave oven because of the oven door being always towards one direction.

The present utility model adopts technical schemes as follows: a revolving base of microwave oven, comprising the upper chassis fixedly connecting with the bottom of main body of the microwave oven, the nether chassis movably locating under the upper chassis, the upper distribution box locating on the bottom of the upper chassis, the nether distribution box locating on the top side of the nether chassis, idler wheel groups cooperating between the upper chassis and the nether chassis to make both of them can correspondingly wheel; the upper chassis, the upper distribution box, the nether distribution box and the nether chassis axially locate through a bolt; a smaller conducting ring and a bigger conducting ring are embedded in the bottom of the upper distribution box, the smaller conducting ring and the bigger conducting ring center on the screw, the smaller conducting ring and the bigger conducting ring respectively have electrical, union joints drilling through upwards the upper distribution box; a smaller conducting strip and a bigger conducting strip are embedded in the top side of the nether distribution box; the smaller conducting strip and the bigger conducting strip respectively have resilient contacts extending upwards, which respectively contact with the smaller conducting ring and the bigger conducting ring; the smaller conducting strip and the bigger conducting strip also have electrical connections drilling through downwards the nether distribution box. The electrical connection of the smaller conducting strip and the electrical connection of the bigger conducting strip connect with external power source; the electrical union joint of the smaller conducting ring and the electrical union joint of the bigger conducting ring supply power for microwave oven. When the upper chassis and the nether chassis relatively wheel, the smaller conducting ring and the bigger conducting ring still correspondingly connect with the smaller conducting strip and the bigger conducting strip for supplying power for microwave oven.

A revolving base of microwave oven according to claim 1 wherein a screw with head drills through the upper chassis and the upper distribution box and the nether distribution box and the nether chassis from the top down, a nut locks at the end of the screw; a turnplate locates under the screw; the turnplate has ball bearings rolling around circle between the turnplate and the nether chassis. The structure ensures that the bolting will not effect the wheel of the upper chassis and the nether chassis.

The upper distribution box forms a basin-shaped part with upward opening; the lateral wall of the upper distribution box extends around to form a locating face cooperating with the underside of the nether chassis; the middle part of the underside of the upper distribution box forms a distance sleeve around the screw to make the upper distribution box and the nether distribution box have a distance; the top side of the nether distribution box has a annular wall extending upwards, the annular wall encircles the basin-shaped part of the upper distribution box and encircles the bigger conducting ring and the smaller conducting ring and the bigger conducting strip and the smaller conducting strip; the middle part of the nether chassis caves downwards to form a basin-shaped circumambience part encircling the upper distribution and the nether distribution box, the side wall of the circumambience part has through hole as the access of the power line; the middle part of the circumambience part heaves upwards to form a protruding part, the lower part of protruding part forms a containing room, said screw and turnplate and ball bearings locate in the containing room; orientational protruding parts locate around the protruding part and in the circumambience part; the orientational protruding parts have location notches to accept the orientational protruding posts of the nether distribution box.

The idler wheel groups comprise some roller carriers locating at the top side of the nether chassis, some roller shafts cooperating with roller carriers and some idler wheels cooperating with roller shafts; the upper chassis has annular recess for the rolling of the idler wheels.

Comparing with existing technologies, the present utility model has virtues as follows: microwave oven can circumvolve relative to cabinet or table, so user can expediently take food out from microwave oven no matter where the user is, doing without moving the microwave oven, and can ensure the good power supply of the microwave oven.

BRIEF INTRODUCTIONS OF THE ATTACHED DRAWINGS

EMBODIMENT

Referring to FIGS. 1 to 7, it is the embodiment of the present utility model.

Figure 1:
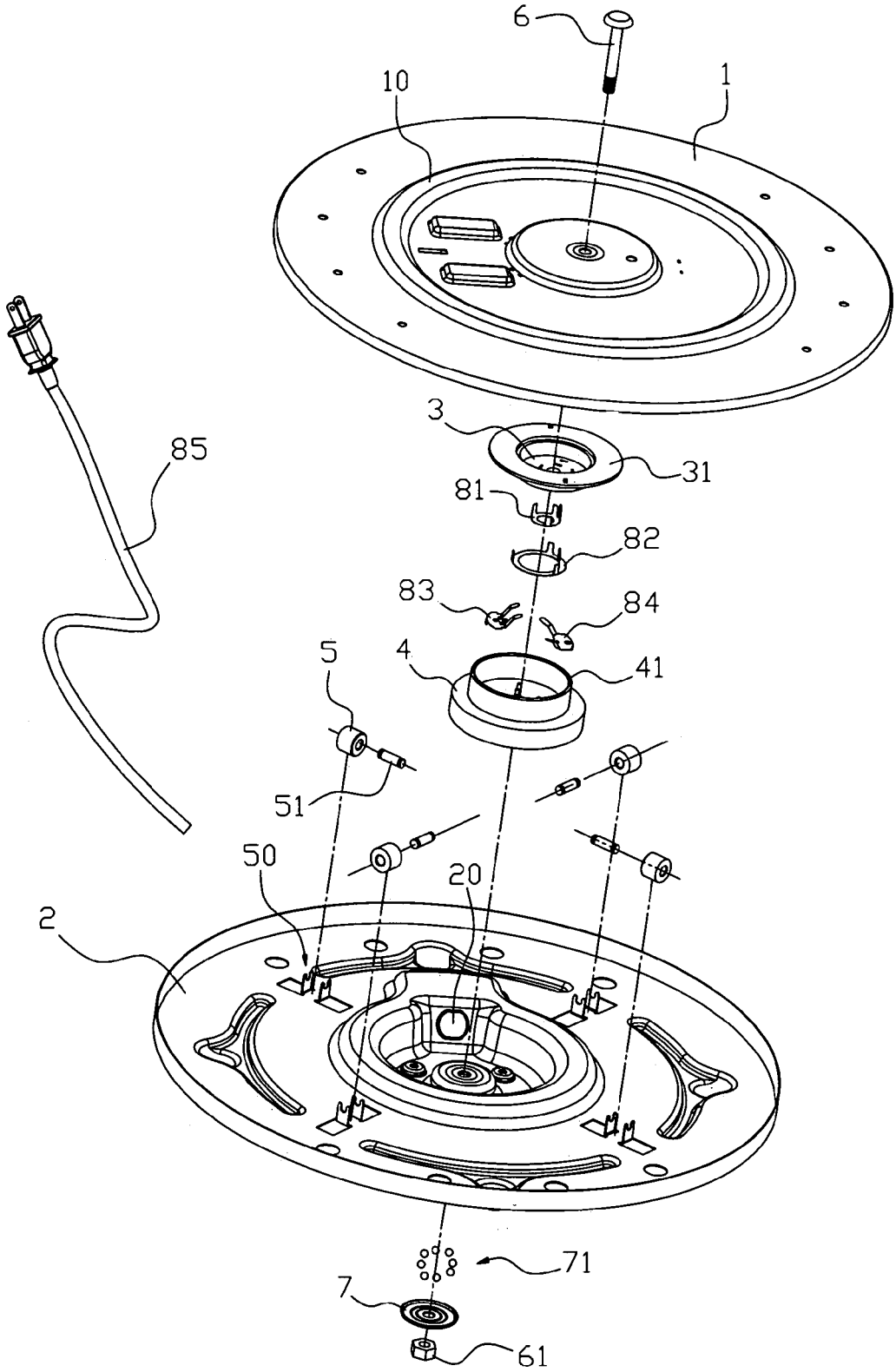
FIG. 1 is the three-dimensional explosion views of the present utility model.

Referring to FIG. 1, the revolving base of microwave oven, comprising the upper chassis 1 fixedly connecting with the bottom of main body of the microwave oven, the nether chassis 2 movably locating under the upper chassis 1, the upper distribution box 3 locating on the bottom of the upper chassis 1, the nether distribution box 4 locating on the top side of the nether chassis 2, idler wheel groups cooperating between the upper chassis 1 and the nether chassis 2 to make both of them can correspondingly wheel; the upper chassis 1, the upper distribution box 3, the nether distribution box 4 and the nether chassis 2 axially locate through a screw 6 and a nut 61.

Figure 2:
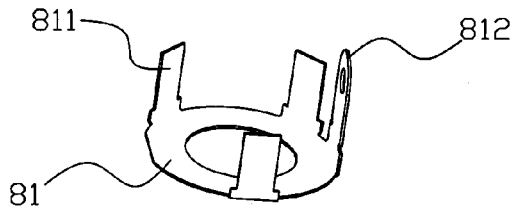
FIG. 2 is the three-dimensional structure sketch map of the smaller conducting ring of the present utility model.
Figure 3:
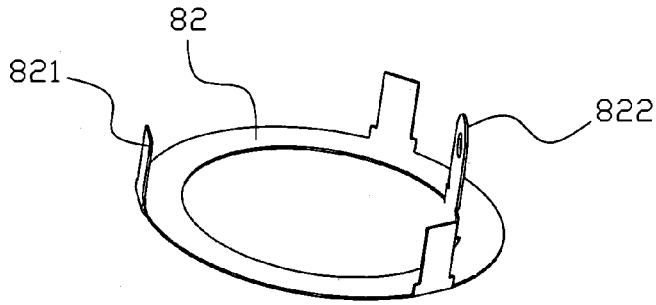
FIG. 3 is the three-dimensional structure sketch map of the bigger conducting ring of the present utility model.
Figure 4:
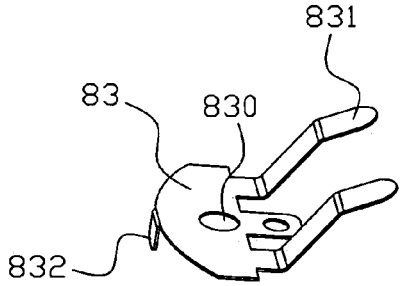
FIG. 4 is the three-dimensional structure sketch map of the smaller conducting strip of the present utility model.
Figure 5:
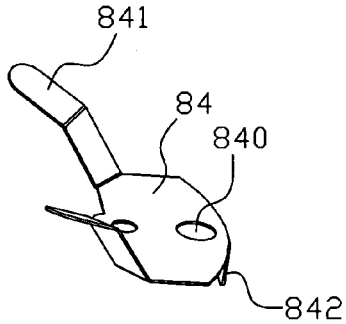
FIG. 5 is the three-dimensional structure sketch map of the bigger conducting strip of the present utility model.

Referring to FIGS. 2 and 3, a smaller conducting ring 81 and a bigger conducting ring 82 are embedded in the bottom of the upper distribution box 3, the smaller conducting ring 81 and the bigger conducting ring 82 center on the screw 6. The smaller conducting ring 81 and the bigger conducting ring 82 respectively have electrical union joints 812 and 822; the electrical union joints 812 and 822 drill through upwards the upper distribution box 3 for supplying power for microwave oven. Three fixed pieces 811 dispose around the smaller conducting ring 81 and three fixed pieces 821 dispose around the bigger conducting ring 82. The smaller conducting ring 81 and the bigger conducting ring 82 fix in the bottom side of the upper distribution box 3 by fixed pieces 811 and fixed pieces 821. Referring to FIGS. 4 and 5, a smaller conducting strip 83 and a bigger conducting strip 84 are embedded in the top side of the nether distribution box 4. The smaller conducting strip 83 and the bigger conducting strip 84 respectively have resilient contacts 831 and 841 extending upwards, which respectively contact with the smaller conducting ring 81 and the bigger conducting ring 82; the smaller conducting strip 83 and the bigger conducting strip 84 also have electrical connections 832 and 842 drilling through downwards the nether distribution box 4. The smaller conducting strip 83 and the bigger conducting strip 84 have location holes 830 and 840 to accept orientation protuberant parts of the nether distribution box 4.

Figure 7:
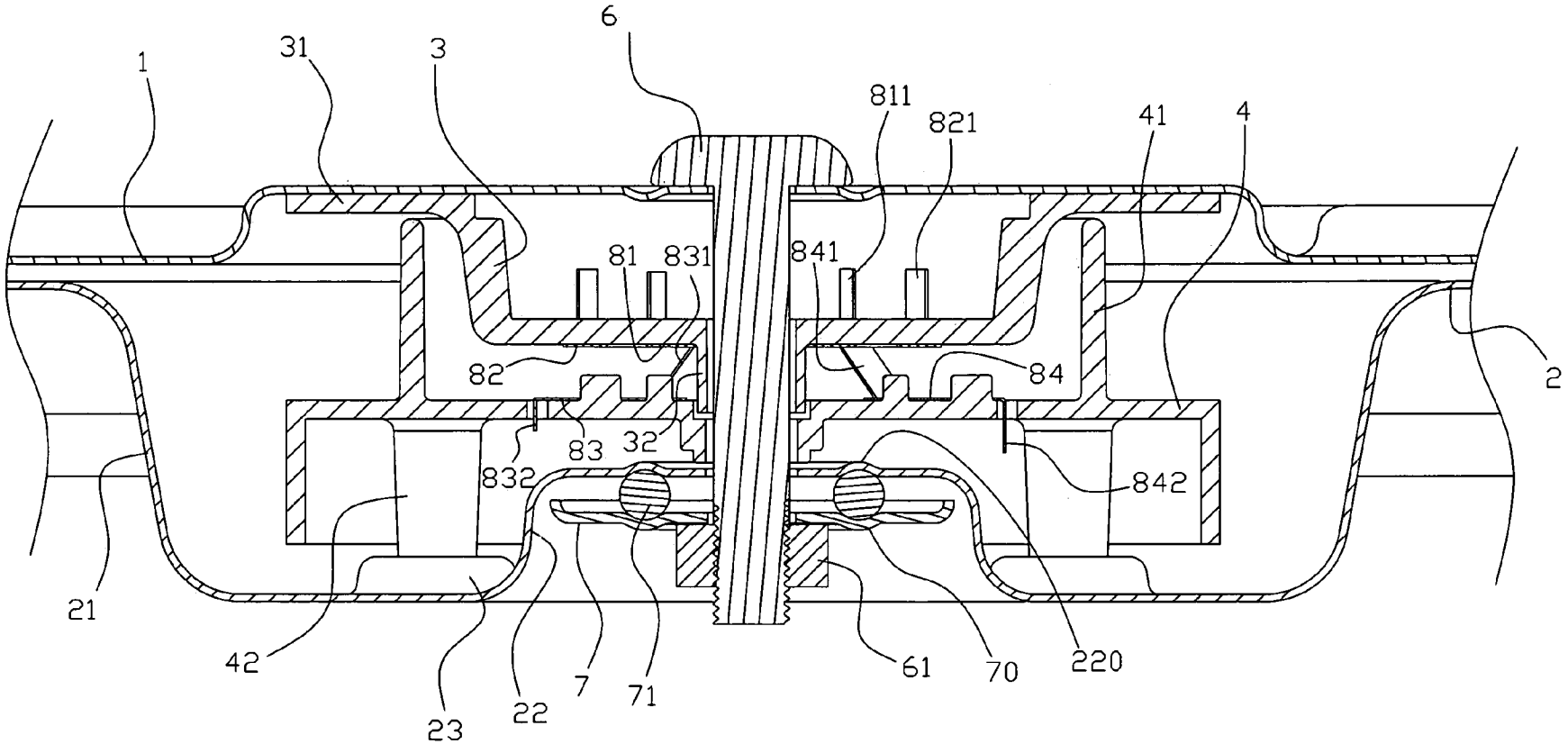
FIG. 7 is the drawing of partial enlargement in the middle part of the FIG. 6.

The electrical connection 831 of the smaller conducting strip 83 and the electrical connection 841 of the bigger conducting strip 84 connect with external power source; the electrical union joint 812 of the smaller conducting ring 81 and the electrical union joint 822 of the bigger conducting ring 82 supply power for microwave oven. When the upper chassis 1 and the nether chassis 2 relatively wheel, the smaller conducting ring 81 and the bigger conducting ring 82 still correspondingly connect with the smaller conducting strip 83 and the bigger conducting strip 84 for supplying power for microwave oven. Referring to FIG. 7, it is the connected relation of the smaller conducting ring 81 and the bigger conducting ring 82 and the smaller conducting strip 83 and the bigger conducting strip 84 and the upper distribution box 3 and the nether distribution box 4.

Figure 6:
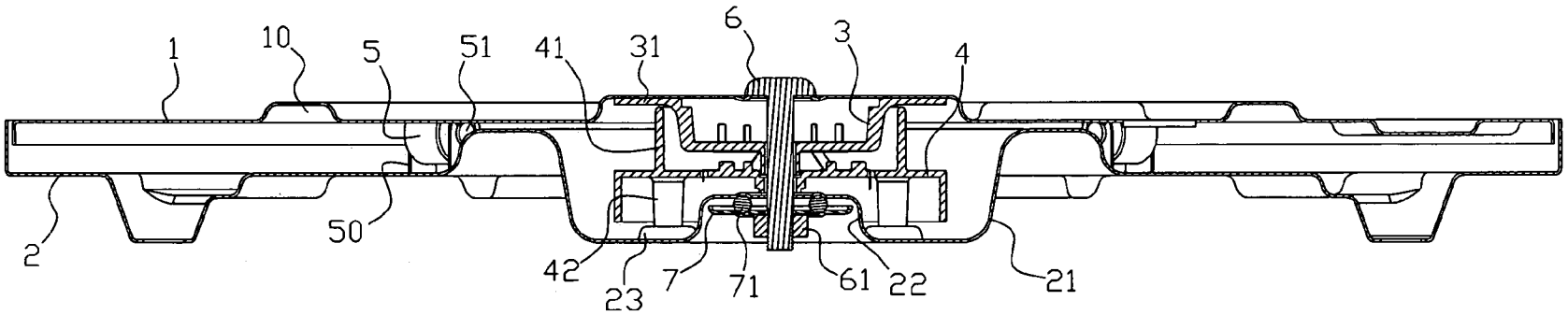
FIG. 6 is the section structure sketch map of the present utility model.

Referring to FIGS. 1 and 6 and 7, a screw 6 with head drills through the upper chassis 1 and the upper distribution box 3 and the nether distribution box 4 and the nether chassis 2 from the top down, a nut 61 locks at the end of the screw 6. A turnplate 7 locates under the screw 6; the turnplate 7 has ball bearings 71 rolling around circle between the turnplate 7 and the nether chassis 2. The top side of the turnplate 7 and the underside of the nether chassis 2 respectively have annular recesses 70 and 220 for rolling of the ball bearings 71; the annular recesses 70 and 220 correspond up and down for accepting the ball bearings 71. The structure ensures that the bolting will not effect the wheel of the upper chassis 1 and the nether chassis 2.

Referring to FIGS. 6 and 7, the upper distribution box 3 forms a basin-shaped part with upward opening; the lateral wall of the upper distribution box 3 extends around to form a locating face 31 cooperating with the underside of the nether chassis, the location mode is by concavo-convex cooperation in horizontal direction and by the screw 6 and the nut 61 in elevation direction. The middle part of the underside of the upper distribution box 3 forms a distance sleeve 32 around the screw 6 to make the upper distribution box 3 and the nether distribution box 4 have a distance; the top side of the nether distribution box 4 has a annular wall 41 extending upwards, the annular wall 41 encircles the basin-shaped part of the upper distribution box 3 and encircles the bigger conducting ring 82 and the smaller conducting ring 81 and the bigger conducting strip 84 and the smaller conducting strip 83; the middle part of the nether chassis 2 caves downwards to form a basin-shaped circumambience part 21 encircling the upper distribution 3 and the nether distribution box 4, referring to FIG. 1, the side wall of the circumambience part 21 has through hole 20 as the access of the power line 85; the middle part of the circumambience part 21 heaves upwards to form a protruding part 22, the lower part of protruding part 22 forms a containing room, said screw 6 and turnplate 7 and ball bearings 71 locate in the containing room. Some orientational protruding parts 42 locate around the protruding part 22 and in the circumambience part 21; the orientational protruding parts 42 have location notches to accept the orientational protruding posts 42 of the nether distribution box 4 for the orientation of the nether distribution box 4 and the nether chassis 2 in the horizontal direction.

Referring to FIGS. 1 and 7, the idler wheel groups 51 between the upper chassis 1 and the nether chassis 2 comprise four roller carriers 50 locating at the top side of the nether chassis 2, four roller shafts 51 cooperating with the four roller carriers 50 and four idler wheels 5 cooperating with roller shafts 51; the upper chassis 1 has annular recess 10 for the rolling of the idler wheels 5. In FIG. 1, the annular recess 10 looks like raised ring on account of the visual angle.

While the present utility model has been described in connection with what is considered the most practical and preferred embodiment; for example, the idler wheel groups 5 can be replaced by ball bearing and ball bearing frames, the smaller conducting strip 83 and the bigger conducting strip 84 can be replaced by two carbon brushes; it is understood that present utility model is not limited to the disclosed embodiment but is intended to cover various arrangements included within the spirit and scope of the broadest interpretation so as to encompass all such modifications and equivalent arrangements.

The invention claimed is:

1. A revolving base of a microwave oven, comprising: an upper chassis fixedly connecting with a bottom of a main body of the microwave oven, a nether chassis movably located under the upper chassis, an upper distribution box located on a bottom of the upper chassis, a nether distribution box located on a top side of the nether chassis, idler wheel groups cooperating between the upper chassis and the nether chassis to make both of them correspondingly rotate; the upper chassis, the upper distribution box, the nether distribution box and the nether chassis axially locate through a screw; a smaller conducting ring and a bigger conducting ring are embedded in the bottom of the upper distribution box, the smaller conducting ring and the bigger conducting ring center on the screw, the smaller conducting ring and the bigger conducting ring respectively have electrical union joints extending upwards through the upper distribution box; a smaller conducting strip and a bigger conducting strip are embedded in the top side of the nether distribution box; the smaller conducting strip and the bigger conducting strip respectively have resilient contacts extending upwards, which respectively contact with the smaller conducting ring and the bigger conducting ring; the smaller conducting strip and the bigger conducting strip also have electrical connections extending downwards through the nether distribution box.

2. A revolving base of a microwave oven according to claim 1 wherein the screw has a head and extends through the upper chassis and the upper distribution box and the nether distribution box and the nether chassis from the top down, a nut locks at the end of the screw; a turnplate locates under the screw; the turnplate has ball bearings rolling around circle between the turnplate and the nether chassis.

3. A revolving base of a microwave oven according to claim 2 wherein the upper distribution box forms a basin-shaped part with an upward opening; a lateral wall of the upper distribution box extends around to form a locating face cooperating with the underside of the nether chassis; a middle part of the underside of the upper distribution box forms a distance sleeve around the screw to make the upper distribution box and the nether distribution box have a distance; the top side of the nether distribution box has an annular wall extending upwards, the annular wall encircles the basin-shaped part of the upper distribution box and encircles the bigger conducting ring and the smaller conducting ring and the bigger conducting strip and the smaller conducting strip; the middle part of the nether chassis caves downwards to form a basin-shaped circumambience part encircling the upper distribution and the nether distribution box, the side wall of the circumambience part has through hole as the access of the power line; the middle part of the circumambience part heaves upwards to form a protruding part, the lower part of protruding part forms a containing room, said screw and turnplate and ball bearings are located in the containing room; orientational protruding parts locate around the protruding part and in the circumambience part; the orientational protruding parts have location notches to accept the orientational protruding posts of the nether distribution box.

4. A revolving base of a microwave oven according to claim 1 wherein said idler wheel groups comprise roller carriers locating at the top side of the nether chassis, roller shafts cooperating with roller carriers and idler wheels cooperating with the roller shafts; said upper chassis has an annular recess for the rolling of the idler wheels.

* * * * *